US008384528B2

(12) United States Patent
McCarthy et al.

(10) Patent No.: US 8,384,528 B2
(45) Date of Patent: Feb. 26, 2013

(54) METHOD AND APPARATUS FOR SELECTIVELY VARYING MOTOR VEHICLE SOUNDS

(75) Inventors: Mark W. McCarthy, Ann Arbor, MI (US); Mark L. Clapper, Ann Arbor, MI (US); Ming-Ran Lee, Troy, MI (US); Lloyd Bozzi, Saline, MI (US); Prakash Thawani, Bloomfield Hills, MI (US); Raymond L. Coppiellie, Canton, MI (US)

(73) Assignee: Ford Global Technologies, Dearborn, MI (US)

( * ) Notice: Subject to any disclaimer, the term of this patent is extended or adjusted under 35 U.S.C. 154(b) by 722 days.

(21) Appl. No.: 11/625,485

(22) Filed: Jan. 22, 2007

(65) Prior Publication Data

US 2007/0182525 A1 Aug. 9, 2007

Related U.S. Application Data

(60) Provisional application No. 60/761,090, filed on Jan. 23, 2006.

(51) Int. Cl.
*G08B 3/10* (2006.01)

(52) U.S. Cl. ..... 340/384.3; 381/71.4; 381/71.5; 381/86; 123/184.21; 123/184.57

(58) Field of Classification Search ..... 340/3.1, 340/825, 384.3, 1.1; 381/61, 64, 71.1, 71.5, 381/71.7, 71.4, 86; 123/184.21, 184.57
See application file for complete search history.

(56) References Cited

U.S. PATENT DOCUMENTS

| | | | | |
|---|---|---|---|---|
| 5,060,271 | A | 10/1991 | Geddes | |
| 5,388,408 | A | 2/1995 | Lawrence | |
| 5,452,578 | A | 9/1995 | Barber | |
| 5,541,373 | A | 7/1996 | Cheng | |
| 5,693,918 | A | 12/1997 | Bremigan et al. | |
| 5,848,168 | A | 12/1998 | Shipps et al. | |
| 5,860,400 | A | 1/1999 | Stuart et al. | |
| 6,633,646 | B1 | 10/2003 | Hwang | |
| 6,732,509 | B2 | 5/2004 | Shiga | |
| 6,732,510 | B2 | 5/2004 | Ciray | |
| 7,357,220 | B2 * | 4/2008 | Horikou | 181/250 |
| 2005/0201567 | A1 * | 9/2005 | Browne et al. | 381/71.5 |
| 2005/0259830 | A1 | 11/2005 | Vaishya | |
| 2009/0134983 | A1 * | 5/2009 | Tischer | 340/384.3 |

FOREIGN PATENT DOCUMENTS

| | | |
|---|---|---|
| FR | 2858710 | 8/2003 |
| WO | WO0133543 | 5/2001 |

* cited by examiner

*Primary Examiner* — Brian Zimmerman
*Assistant Examiner* — Sara Samson
(74) *Attorney, Agent, or Firm* — Raymond L. Coppiellie; Tung & Associates

(57) ABSTRACT

An apparatus and method for customizing the sound emitted from an automotive vehicle during operation. Specifically, the vehicle operator uses a controller to vary the sound emitted from the engine exhaust and intake or engine compartment sounds during vehicle operation. In addition, the operator can control the sound level, sound type and sound aspect in the vehicle interior or passenger compartment and the vehicle exterior. Further, the apparatus uses an active sound control system, such as those using microphones and speakers, to customize and/or tune the sound emanating from the vehicle.

10 Claims, 1 Drawing Sheet

METHOD AND APPARATUS FOR SELECTIVELY VARYING MOTOR VEHICLE SOUNDS

BACKGROUND OF THE INVENTION

1. Field of the Invention

The present invention relates to an apparatus and method for providing a vehicle operator with an opportunity to tune or customize the sound emanating from a vehicle during operation.

2. Description of Related Art

Individuals expect vehicles to sound a particular way and often associate the perceived sound of a vehicle with vehicle quality. For example, sports cars are expected to have a loud, aggressive powerful sound while luxury vehicles are expected to have a quiet, rich powerful sound. In addition, sound quality provides a customer or vehicle operator with a distinctive image of a vehicle. For example, an individual often bases their perception of a vehicle as responsive and sporty or tough and capable on the sound emanating from the vehicle. Thus, sound gives an individual a sense of the vehicle's powerfulness, effortlessness or refinement. In addition, an individual often associates vehicle sounds with particular vehicles or vehicle types. Accordingly, the sound should work in harmony to support and provide brand and nameplate association.

In many instances, an individual may wish to modify and thus personalize or customize the sound emanating from their vehicle. For example, different individuals may wish the same vehicle to sound different. One may want a more powerful sound and one may want a quieter sound. In addition, an individual may wish to further customize or vary sound depending on the particular use and driving location of the vehicle. For example, there may be sound restrictions in urban or different geographic areas such as those located around hospitals, schools and residential neighborhoods.

SUMMARY OF THE INVENTION

Accordingly, the present invention provides a sound control system whereby a vehicle operator can control and vary the sound, including the engine exhaust and intake sounds, emanating from the vehicle during operation. In one embodiment of the invention, the vehicle operator uses a controller, including an input mechanism, to select and control various systems located on the vehicle to modify the sound emanating from the vehicle. The present invention enables the vehicle operator to control the sound level, sound aspect and sound type emanating from the exhaust system, the intake system, the vehicle interior or passenger compartment and the vehicle exterior. In addition to using mechanical means; such as feedback tubes, switchable resonators, continuously variable resonators, and other valve and flow control systems, active sound control systems such as those using microphones and speakers are also used to customize and/or tune the sound emanating from the vehicle.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
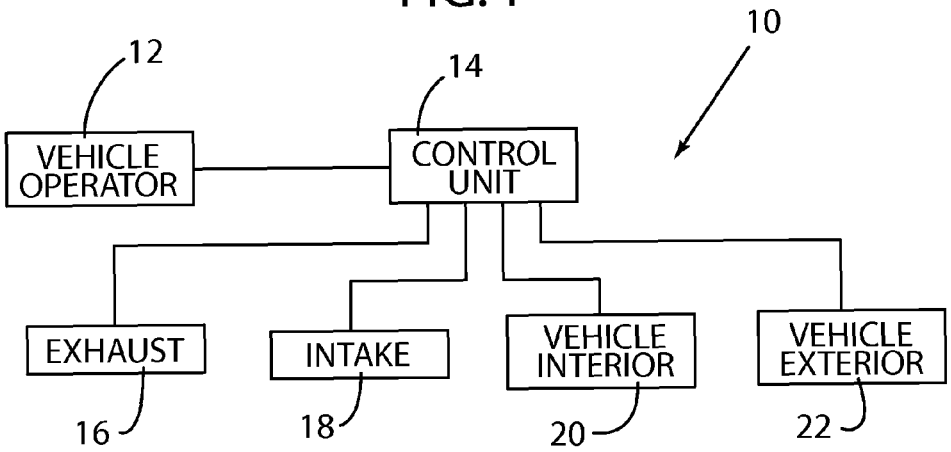
FIG. 1 is a block diagram illustrating the basic components of one embodiment of the present invention.

Referring to FIG. 1, there is shown a block diagram of one embodiment of a customer tunable engine exhaust/intake sound system 10 according to the present invention. As illustrated in the block diagram of the customer tunable engine exhaust/intake sound system 10 a vehicle operator 12 operates a control unit 14 to correspondingly control the sound level emitted from the various systems or areas of a motor vehicle. As illustrated, the control unit 14 controls various aspects, including the level of sound emitted from the exhaust 16, the intake/engine compartment 18, the vehicle interior 20 and the vehicle exterior 22. Accordingly, the vehicle operator can use the control unit 14, as set forth more fully herein, to customize the vehicle's sound.

Figure 2:
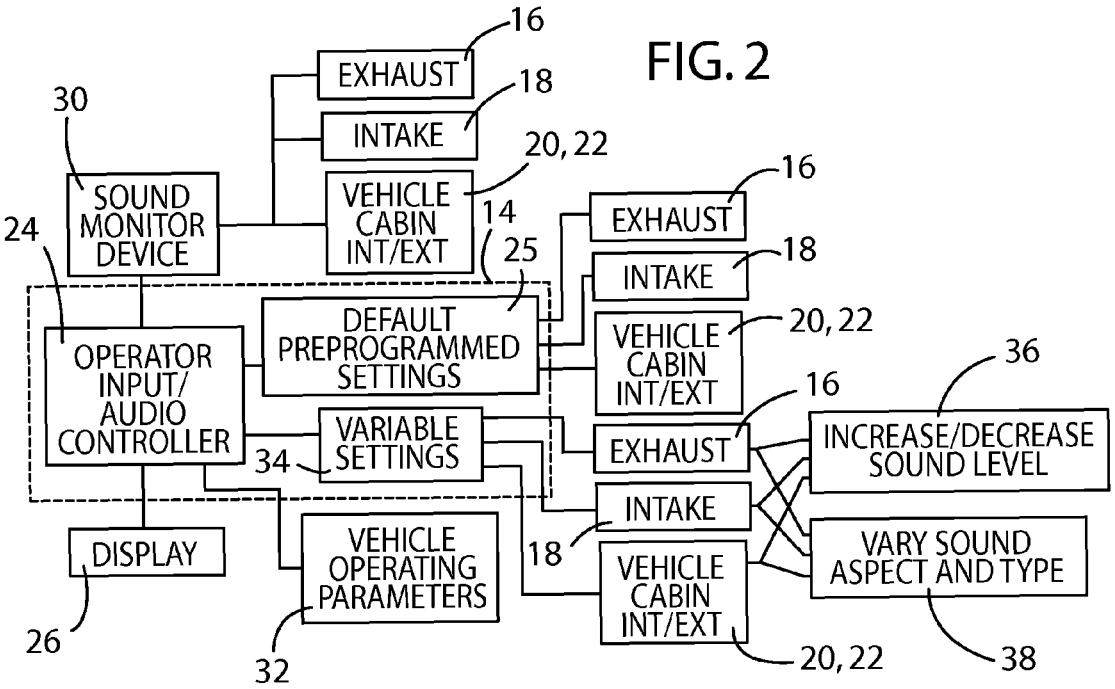
FIG. 2 is a block diagram further illustrating the components of one embodiment of the present invention.

The block diagram of FIG. 2 illustrates generally how the vehicle operator controls the vehicle's sound. Initially, the vehicle operator inputs, or selects from a preprogrammed menu, various parameters associated with the vehicle's sound from an input/audio controller 24 that acts in connection with a programmable memory 25 to form the control unit 14. A display 26 attached to the input/audio controller 24 enables the operator to see or visually review the particular sound parameter being adjusted or selected. The controller 24 may include a graphical user interface, toggle switch, button or other mechanism enabling the vehicle operator to choose and select a particular sound parameter.

The present embodiment contemplates using the audio controller; i.e., the vehicle radio or other sound controller associated with the vehicle sound or entertainment system. Specifically, the audio controller 24 would include an additional selection or setting enabling the user to choose various vehicle sound parameters. For example, the audio controller used with the vehicle sound or entertainment system has the ability to adjust along with other parameters the balance, treble, base and fade of the vehicle speakers. Accordingly, the present invention contemplates adding an additional selectable level or category such as vehicle sound or engine exhaust/intake sound system. The vehicle user then uses the audio controller 24 to select a particular parameter such as the engine exhaust/intake sound system. Once selected, the audio controller 24 then provides additional selections or options enabling a multitude of adjustments by the vehicle operator, for example, the ability to adjust the exhaust sound, the intake or engine compartment sound, vehicle interior sound and vehicle exterior sound. The vehicle audio controller 24 and associated programmable memory 25 also contain the control strategy and operational hierarchy for each of the vehicle sound devices 16, 18, 20, 22 thereby eliminating the need for separate controllers or control units associated with each system. Thus, the present invention contemplates use of one, fully integrated control unit 14 that contains all of the hardware and software necessary to operate each of the respective systems. In addition the preset buttons located on the audio controller 24, such as those located on the radio/entertainment system, may also be used to preset various sound profiles for the vehicle and would enable customized sound profile presets also. Incorporating all of the functions into a single audio controller or control unit 14 saves additional control systems and enables the various sound systems to function together in a more simple fashion.

In addition, utilizing a single audio controller or control unit 14 makes uploading information and control strategies much easier. Thus additional sound profiles, customer desired sounds and other modifications to the system may be easily made using a hardwire plug connection at the dealership, a wireless connection, connection to a computer such as a laptop computer and other file transfer means by which information can be uploaded to the control unit 14. In addition, the present invention contemplates the use of an equalizer type control unit 14 whereby the audio controller can adjust various ranges and sound levels.

Accordingly, the controller 14, stores in the programmable memory 25 the settings and output control strategy used for the various subsystems located on the vehicle to achieve the selected sound levels. For example, when the controller 14 receives an input from the operator through the audio controller 24 relating to a default or preprogrammed setting it outputs a control strategy to the exhaust system 16, intake system 18 and vehicle interior or exterior 20, 22. By modifying the sound level emitted in these areas or by specific systems, the vehicle operator can achieve a desired sound level both inside and outside of the vehicle.

It should be understood that the sound level of the exhaust system 16 can be varied through a multitude of different ways. For example, a mechanical system utilizing a spring based valve system positioned adjacent the vehicle muffler variably controls flow through the exhaust and correspondingly controls the sound level emitted by the muffler. Other examples of a mechanism that varies the sound emitted from the exhaust include movement of a mechanically actuated sliding resonance pipe or tube located within the muffler and a piezo-electric system attached to the muffler. Other mechanisms can also be used to vary the sound emitted from the exhaust.

In addition to the various mechanical systems set forth above, active systems utilizing microphones and speakers or wave generators are also used to modify or change the sound of the exhaust. The use of a speaker or wave generator can add a low wave frequency which correspondingly improves base or low range sound emanating from the exhaust and enables the operator to increase or decrease the low-range sound. In addition, the present invention further contemplates adding a subwoofer to the exhaust system to increase the base level in the exhaust system. The subwoofer could also be used for increasing the base levels in the vehicle audio or entertainment system. These are just several examples of methods that can be used to adjust the sound level emanating from the vehicle exhaust 16. Accordingly, connecting the exhaust system 16 in this matter to the audio controller 24 enables the operator to adjust various sound characteristics including the level and distinctiveness thereof.

Like the exhaust system 16, the sound level of the intake system 18 can also be mechanically adjusted. For example, feedback tubes or chambers may be used to increase or decrease the sound level. In addition, switchable resonators that select multiple intake or induction chambers can be used. Also, a continuously variable resonator which changes in length or changes the volume of a resonance chamber is also contemplated for use to vary the sound level of the intake/engine compartment. Accordingly, depending upon the particular mechanical system used, the vehicle operator through the audio controller 24 utilizes the particular mechanical system selected to vary the sound of the intake/engine compartment 18.

As with the exhaust system 16, the intake system 18 may also utilize an active system for sound level adjustment. Specifically, a speaker based system may be placed in the air induction inlet or in the engine compartment whereby it operates to add to or modify the sound emanating from the intake/engine compartment. Accordingly, the vehicle operator can select different exhaust 16 and intake 18 sound levels.

In addition, it is contemplated that the vehicle operator may also regulate or control the sound both inside and outside the vehicle cabin. For example, in addition to regulating the sound from the exhaust system 16 and the intake system 18, the vehicle operator may also use an active sound system, including microphones and speakers placed or located in the interior and exterior of the vehicle to achieve a desired vehicle sound. Such a system may receive input from sound monitoring devices 30, such as microphones located near the vehicle exhaust, intake/engine compartment and vehicle cabin, along with vehicle operating parameters 32 to output a particular sound into the vehicle interior and exterior in accordance with desired operating conditions or levels. For example, the operator may increase the sound inside the vehicle cabin or passenger compartment while decreasing the sound emanating from the vehicle exterior.

Accordingly, the present invention allows the vehicle operator to vary and select the exhaust sound, intake/engine compartment sound along with the sound located in the interior and exterior of the vehicle. As set forth above these settings may be default or preprogrammed settings whereby the vehicle operates in a performance mode, a luxury mode, a quiet mode, a street mode or highway mode. All of which are preprogrammed settings which simply require the operator to push a preset button.

As indicated in FIG. 2 the operator also has the option of using the audio controller 24 to input their own select settings whereby the operator can customize or tune the engine exhaust, intake and vehicle interior and exterior sounds to his or her own preferences. As illustrated, the audio controller 24 connects to variable setting programming 34 whereby the exhaust 16, intake 18 and vehicle cabin interior and exterior 20, 22 are independently controlled. As illustrated by blocks 36, 38 the variable settings enable the operator to increase or decrease the sound level emitted from or at the various components. In addition, the operator may also vary the sound aspect and type as shown in block 38. Thus, the exhaust sound 16 is independently adjustable from the intake/engine compartment 18 sound and the sound generated by the active sound system located within the interior or exterior of the vehicle cabin. Accordingly, the operator may independently vary each of the vehicle sound systems to achieve their own particular personalized or customized vehicle sound. For example, the operator may choose to increase the base level of the exhaust while decreasing the sound level of the intake or engine compartment. Thus, the operator has the ability to control the sound and sound levels emanating from the vehicle to achieve a desired vehicle sound profile both inside and outside of the vehicle.

The invention further contemplates that various sound profiles and configurations may be made available by the vehicle manufacturer either online or at the vehicle dealership. Accordingly, a vehicle purchaser may download certain sound profiles along with the ability to customize various sounds or sound profiles. Further, the invention contemplates utilizing software to enable the user to create or customize their own sounds, including recording or generating custom sounds along with the ability to share those sounds with others.

It should be further understood that the invention contemplates adjusting or varying the sound level based on vehicle operating parameters such as engine rpm, vehicle speed, intake manifold pressure, exhaust back-pressure, exhaust flow, among others. In addition, the sound profile may be restricted based upon specific vehicle operating parameters 32. Accordingly, the control unit 14 may include preset limits to prevent or reduce excessive sound levels when the vehicle is in neutral, not moving or at a stop. In addition, the invention may utilize a GPS system as part of the control strategy to warn the operator to restrict sound when in an urban area or in a reduced noise environment such as near a hospital, school, residential neighborhood or a quiet zone.

In addition, a microphone or other sensing system placed within the interior cabin may monitor the ambient noise or sound level within the cabin and adjust the sound levels accordingly. For example, the operator may wish that the exhaust system 16, intake system 18 and vehicle exterior 20 all exhibit a sound associated with a powerful and sporty vehicle while the vehicle interior 20 remains quiet. Thus, the active sound control system operates to reduce the sound level within the interior of the vehicle while enabling the vehicle exterior to remain at the desired sound profile.

Further, the present invention may be suitable for hybrid or electric vehicles since the engine or propulsion unit of those vehicles operates in a nontraditional way. Accordingly, the present invention would provide an operator with a mechanism to provide a motor vehicle sound in response to the operation of the vehicle. For example, one method may be to generate vehicle engines sounds occurring when a vehicle begins to move; that is, when the vehicle initially starts to move, the engine noises are typically louder as more power is required to move the vehicle. In addition, as the vehicle increases speed, the vehicle transmission either manual or automatic travels through a range of gears, each gear shift typically resulting in an audible change in the engine noise. Thus, the present invention provides a system and method for simulating the engines sounds typically occurring as the vehicle shifts gears. Further, depending upon the load on the vehicle propulsion unit, the simulated intake and exhaust sounds would vary according to the operating characteristics of the vehicle.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for customizing a vehicle sound profile comprising:

a controller;

a vehicle exhaust, said vehicle exhaust including a mechanism operative to mechanically change a configuration of said vehicle exhaust and thereby vary the sound emitted by said vehicle exhaust such that said vehicle exhaust is configured to emit a plurality of sounds;

a vehicle intake, said vehicle intake configured to emit a plurality of sounds;

a vehicle exterior and a vehicle interior;

at least one sound generator located in said vehicle interior and at least one sound generator located on said vehicle exterior, said controller connected to said sound generator located in said vehicle interior and said controller connected to said sound generator located on said vehicle exterior;

said controller connected to said mechanism of said vehicle exhaust and said vehicle intake, whereby said controller is operative to independently control and vary the sound emitted by each of said vehicle exhaust, said vehicle intake, said sound generator located in said vehicle interior and said sound generator located on said vehicle exterior to create an overall sound profile of the vehicle; and said controller controlling the sound emitted by said vehicle exhaust, said vehicle intake, said sound generator located in said vehicle interior and said sound generator located on said vehicle exterior and correspondingly generating the sound profile in real time wherein the sound profile is a function of and based on vehicle operator commands such that the vehicle operator selects a preprogrammed sound profile wherein the sound levels in the vehicle interior and vehicle exterior vary independently of each other to achieve the sound profile.

2. An apparatus for customizing a vehicle sound profile as set forth in claim 1 including said controller having a plurality of preprogrammed default sound level settings wherein said controller varies the sound emitted by said vehicle exhaust, said vehicle intake, said sound generator located in said vehicle interior and said sound generator located on said vehicle exterior based on an input from said vehicle operator when said vehicle operator selects one of said programmed default sound level settings.

3. An apparatus for customizing a vehicle sound profile as set forth in claim 1 including said controller connected to said exhaust and controlling the sound level and sound type emitted from said exhaust independent of the sound level and sound type emitted from said intake whereby the controller receives an input from a vehicle operator to control the sound level and sound type emitted from said exhaust.

4. An apparatus for customizing a vehicle sound profile as set forth in claim 1 including said controller connected to said intake and controlling the sound level and sound type emitted from said intake independent of the sound level and sound type emitted from said exhaust whereby the controller receives an input from a vehicle operator to control the sound level and sound type emitted from said intake.

5. An apparatus for customizing a vehicle sound profile as set forth in claim 1 including a sound monitoring device, said sound monitoring device monitoring the sound emitted from the vehicle exhaust, vehicle intake, vehicle interior and exterior, said sound monitoring device connected to said controller whereby said controller upon receiving input from said sound monitoring device varies the sound profile of the vehicle based on said sound monitoring device input in accordance with the sound profile based on the vehicle operator's command.

6. An apparatus for customizing a vehicle sound profile as set forth in claim 5 wherein said sound monitoring device includes a microphone located near each of the vehicle exhaust, intake, and vehicle interior and exterior.

7. An apparatus for customizing a vehicle sound profile as set forth in claim 1 including an active system for sound level adjustment; said active system including a speaker that operates to add or modify sound emitted from each of the vehicle exhaust, vehicle intake, vehicle interior and vehicle exterior.

8. An apparatus for customizing a vehicle sound profile as set forth in claim 1 using an active system to modify or change vehicle sound, said active system including microphones, speakers and wave generators connected to said controller and generating an output based on input received at said controller.

9. A vehicle having a customizable sound level comprising:

a vehicle body, said vehicle body including a vehicle cabin said vehicle cabin having a cabin interior and a cabin exterior;

an exhaust, said exhaust including a mechanism operative to mechanically vary the sound emitted by said exhaust;

an intake, said intake configured to vary the sound emitted by said intake;

a control unit;

an input mechanism connected to said control unit;

said control unit connected to said mechanism of said exhaust and said intake whereby said control unit operates to control the sound generated by said exhaust and said intake; and an active system, said active system including microphones, speakers and wave generators connected to said control unit wherein said active system operates to output a particular vehicle sound level based on an input received from said control unit; and adjusting the vehicle sound based on a preprogrammed setting stored in a memory associated with said control unit, said preprogrammed setting selected by a vehicle operator and input to the control unit through said input mechanism whereby said active system operates in connection with the sound generated by the exhaust and intake to achieve the preprogrammed vehicle sound profile both in both the cabin interior and cabin exterior.

10. A vehicle having a customizable sound level as set forth in claim 9 including a sound monitoring device, said sound monitoring device connected to said control unit and operative to vary said sound level of said vehicle as necessary to maintain said preprogrammed vehicle sound level.

* * * * *